US006263591B1

(12) United States Patent
La Porte

(10) Patent No.: US 6,263,591 B1
(45) Date of Patent: Jul. 24, 2001

(54) SPORTS EQUIPMENT DRYING CONTAINER

(76) Inventor: Victor M. La Porte, 1985 Royal Blvd., Elgin, IL (US) 60123

( * ) Notice: Subject to any disclaimer, the term of this patent is extended or adjusted under 35 U.S.C. 154(b) by 0 days.

(21) Appl. No.: 09/490,608

(22) Filed: Jan. 25, 2000

(51) Int. Cl.[7] ..... F26B 13/06

(52) U.S. Cl. ..... 34/622; 34/106; 34/210; 34/211; 34/215; 34/227; 34/233; 34/235; 219/386; 219/400; 219/521

(58) Field of Search ..... 34/618, 619, 621, 34/622, 202, 210, 211, 214, 215, 218, 225, 227, 233, 235, 106; 219/385, 386, 400, 521

(56) References Cited

U.S. PATENT DOCUMENTS

| | | | | |
|---|---|---|---|---|
| D. 394,926 | | 6/1998 | Lindsay . | |
| 3,432,939 | * | 3/1969 | Eichholz | 34/622 |
| 4,180,919 | | 1/1980 | Baltes . | |
| 4,625,432 | | 12/1986 | Baltes . | |
| 4,682,424 | | 7/1987 | Irving . | |
| 4,812,621 | | 3/1989 | Brotherton et al. . | |
| 4,869,872 | | 9/1989 | Baltes . | |
| 5,014,446 | * | 5/1991 | Reesman | 34/620 |
| 5,369,892 | | 12/1994 | Dhaemers . | |
| 5,416,886 | * | 5/1995 | Zahler | 392/382 |
| 5,528,840 | * | 6/1996 | Pajak et al. | 34/622 |
| 5,546,678 | | 8/1996 | Dhaemers . | |
| 5,592,750 | | 1/1997 | Eichten . | |
| 5,666,743 | * | 9/1997 | Dawson | 34/219 |
| 5,713,137 | * | 2/1998 | Fujita | 34/106 |
| 5,839,206 | * | 11/1998 | Lisson et al. | 34/132 |
| 5,930,915 | * | 8/1999 | Dhaemers | 34/511 |
| 5,987,773 | * | 11/1999 | Lipscy | 34/106 |
| 6,134,806 | * | 10/2000 | Dhaemers | 34/404 |

* cited by examiner

*Primary Examiner*—Pamela Wilson
(74) *Attorney, Agent, or Firm*—Thomas R. Vigil

(57) ABSTRACT

The portable sports equipment drying container comprised: a box shaped body; a cover for the body; the body having opposed side walls and opposed end walls; an input fan mounted in one of the walls; an output fan mounted in a another one of the walls; a heating pad in the box shaped body; perforated or porous insulating structure between the heating pad and clothing or equipment placed in the box shaped body; and electrical circuitry for energizing the fans and the heating pad for drying moist or wet clothing or equipment placed in said container and for circulating air through the container.

7 Claims, 2 Drawing Sheets

SPORTS EQUIPMENT DRYING CONTAINER

BACKGROUND OF THE INVENTION

1. Field of the Invention

The present invention relates to a portable container or box for storing athletic equipment and clothing after it has been used, such as hockey clothing and equipment, football clothing and equipment, etc. The clothing and equipment often will be wet from snow, rain and/or perspiration. The drying box or container enables the clothing and equipment to be dried in temporary living quarters, such as a motel room while the player is at a road game, by placing the clothing and equipment into the container and plugging in an electrical cord for energizing fans and a heating pad in the container. Also, the drying box or container can be stored in a player's garage and plugged into an outlet when used 2. Description of the Prior Art Heretofore various analogous and non-analogous devices have been proposed for heating and drying articles, such as clothing and sports equipment. Examples of the previously proposed analogous and non-analogous devices are disclosed in the following analogous and non-analogous U.S. patents:

| U.S. Pat. No. | Patentee |
|---|---|
| Des. 394,926 | Lindsay |
| 4,180,919 | Baltes |
| 4,625,432 | Baltes |
| 4,682,424 | Irving |
| 4,812,621 | Brotherton et al. |
| 4,869,872 | Baltes |
| 5,369,892 | Dhaemers |
| 5,546,678 | Dhaemers |
| 5,592,750 | Eichten |

The Dhaemers U.S. Pat. Nos. 5,369,892 and 5,546,678 are directed in particular to an armoire for receiving articles such as clothing, sports equipment, hockey gear shoes, and other objects for drying them, for sanitizing or sterilizing them to at least some degree, and to filter out odors flowing out of the armoire.

The Eichten U.S. Pat. No. 5,592,750 discloses a tubular rack for supporting clothing, the tubes on the rack having holes or perforations therein whereby heated air from a fragrance dispenser or deodorizer can come down through the holes to the sports equipment supported on the rack.

SUMMARY OF THE INVENTION

According to the present invention, there is provided a portable sports equipment drying container comprising: a box shaped body; a cover for the body; the body having opposed side walls and opposed end walls; an input fan mounted in one of the walls; an output fan mounted in a another one of the walls; a heating pad in the box shaped body; perforated or porous insulating structure between the heating pad and clothing or equipment placed in the box shaped body; and electrical circuitry for energizing the fans and the heating pad for drying moist or wet clothing or equipment placed in said container and for circulating air through the container.

BRIEF DESCRIPTION OF THE PREFERRED EMBODIMENT(S)

Figure 1:
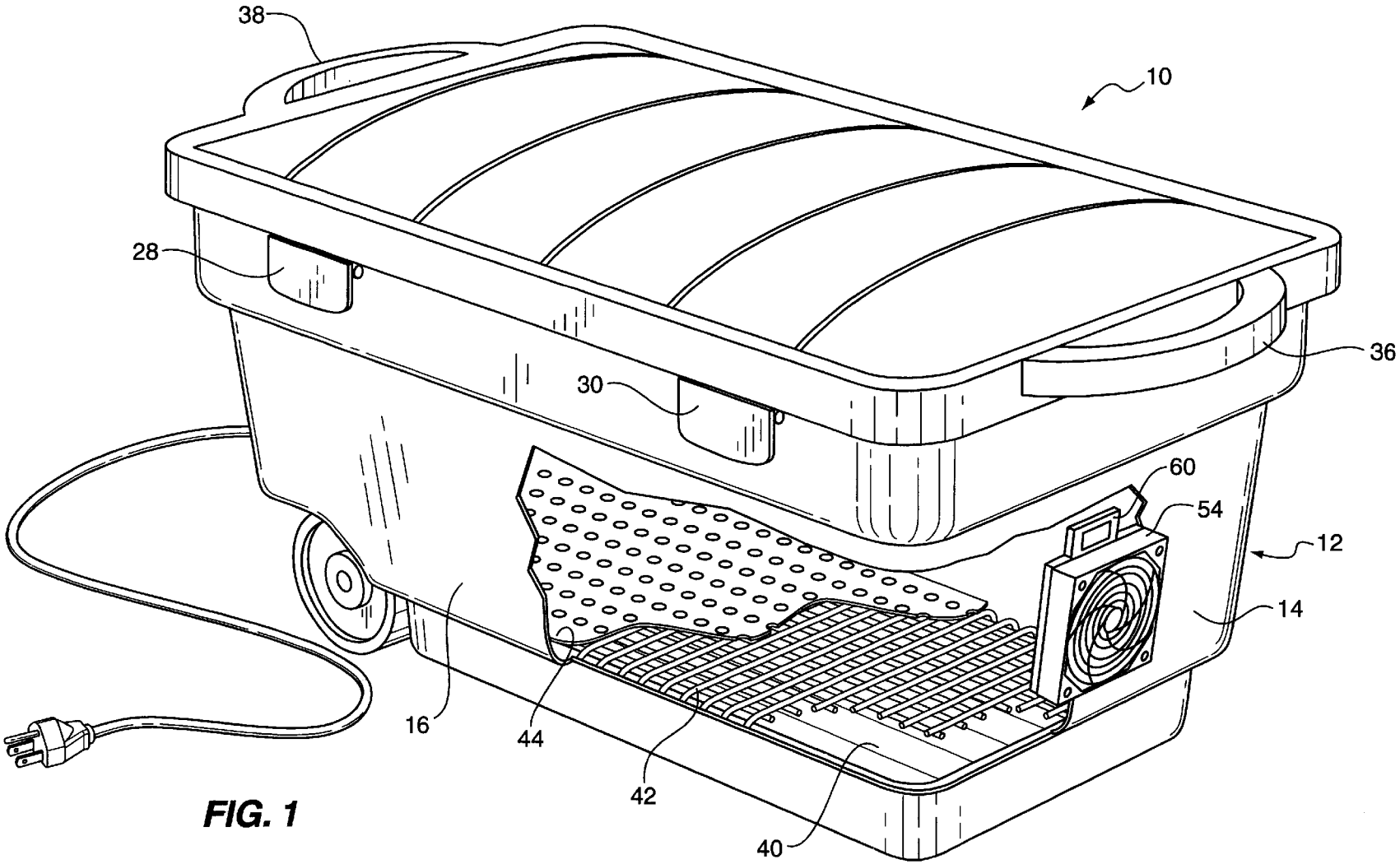
FIG. 1 is a front perspective view of the storage equipment container dryer of the present invention.

Referring now to the drawings in greater detail, there is illustrated therein the sports equipment drying container 10 which includes a simple plastic body or box 12 having four sides on side walls 14,16,18 and 20, a bottom 22, an open top 24 having a movable cover 26 hingedly mounted to one long side 16 of the box 12 at hinges 28 and 30 and a pair of wheels 32 mounted at the bottom 22 below the end side 18. The storage container 10 can be a wheeled storage container of the type sold by Rubbermaid, Inc. under the trademark ROUGHTOTE®.

As shown, the cover 26 has handles 34 and 36 at each end thereof. If desired some form of latch can be provided for latching the cover 26 to the box 12.

Inside the box 12 of the container 10, there is disposed on the bottom 22 a heating or warming pad 40 such as a foot warmer pad 40 which can be of the type sold by Indus-Tool of Chicago, Ill.

Then, positioned on top of the heating or warming pad 40 is a sheet layer or mat 42, which in the illustrated embodiment is a plastic coated mesh 42 sold in hardware stores as hardware cloth. Then, a plastic mat 44, such as a bath mat 44 sold under the Trademark Softex™, is placed on top of the sheet 42 of hardware cloth.

In one preferred embodiment, the sheet 42 of hardware cloth is omitted and two bath mats 44 are positioned over the heating or warming pad 40.

An electrical cord 46 having a plug 48 at an outer end 50 thereof extends out of the box 12 and is connected in the box 12 to the heating or warming pad 40 and to two fans 54 and 58 mounted in the opposed end side walls 14 and and 18. If desired an on/off switch can be provided in the cord 46 or on a side walls 14,16,18 or 20 of the box 12.

Figure 2:
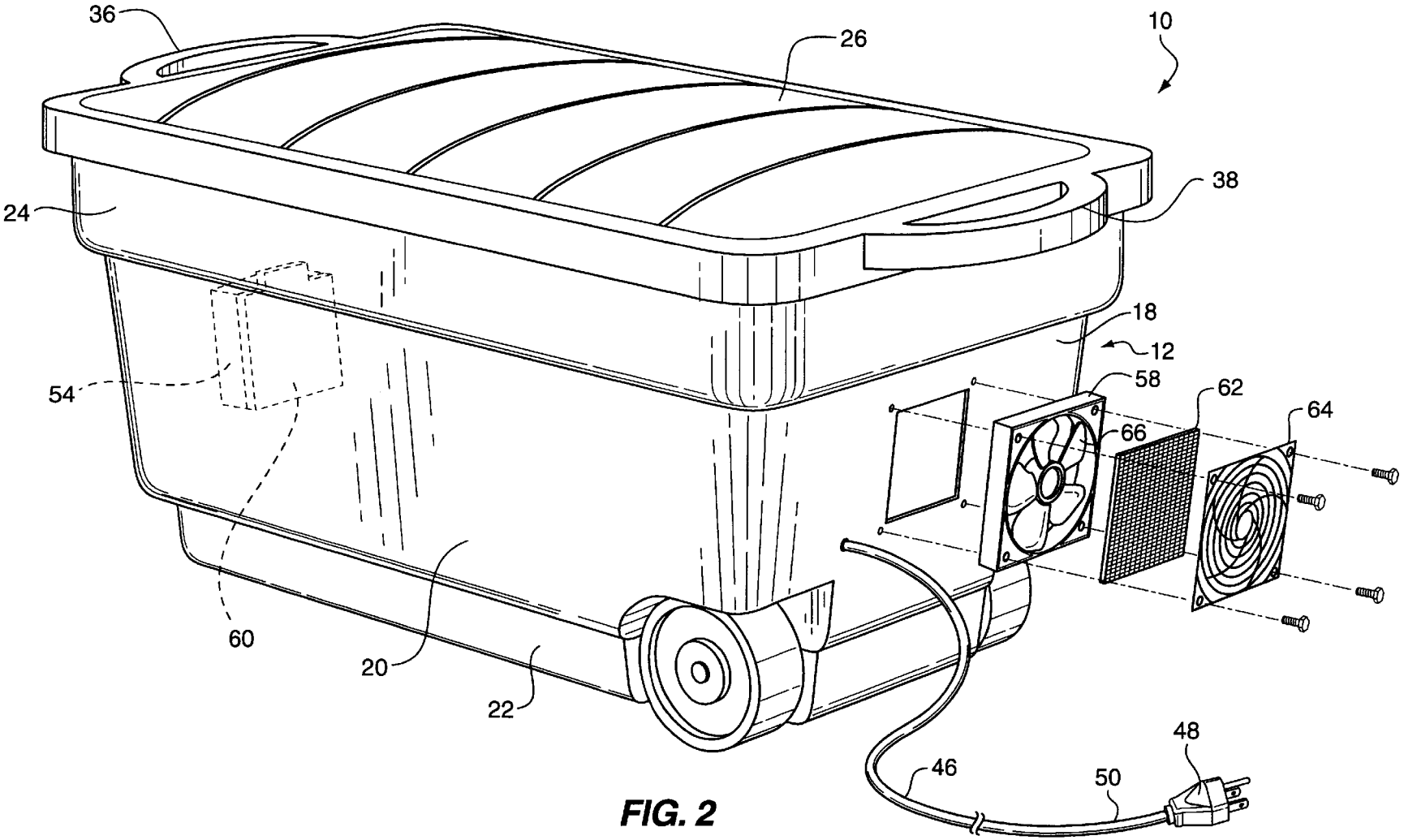
FIG. 2 is rear perspective view of the sports equipment drying container of the present invention shown in FIG. 1.

As shown in FIGS. 1 and 2, the inlet and outlet fans 14 and 18 are mounted, respectively, in the end sides or end walls 14 and 18 of the box 10. Such fans can be AC Axial fans of the type sold under the trademark Dayton® by Dayton Electric Manufacturing Company of Niles, Ill.

In FIG. 1, is illustrated the inlet fan 54 for pulling air into the box 12. An air treatment cartridge 60 of a disinfectant, a sterilizing material, a scent or a deodorizing material is positioned in front of the fan 54 in the box 12 so that air pulled into the container 10 passes through the air treatment cartridge 60.

The air pulled into the box 12 circulates within the box 12 and around and through clothing, helmets, shoes, ice skates, etc., temporarily stored in the container 10 by a sports player after a game, which can be a road game or a home game.

Then, air is pulled out of the box 12 by the outlet fan 58 mounted in the end wall 18, as shown in FIG. 2. As shown in FIG. 2, the outlet fan 58 includes an air filter cartridge 62 and a grating 64. The air filter cartridge 62 is typically a piece of activated carbon impregnated material cut from a sheet of same sold by W. W. Grainger of Morton Grove, Ill. under the trademark AIR HANDLER® and is positioned between a fan blade 66 and the grating 64 of the fan 58 for deodorizing the air blown into the ambient environment.

In use, the sports player, after a game will place his wet, sweaty, dirty equipment and clothing into the container 10 and plug it in. This will start the fans working, i.e., the input fan 54, to pull air into the container through treatment cartridge 60, and the output fan, to pull air out of the container 10 into the ambient environment. At the same time, electrical current is supplied to the heating pad 40 to heat the equipment and clothes in the container 10, as air pulled into the container 10 is circulated in the container 10.

Empirical tests have shown that this sports equipment drying container 10 is very effective in drying the clothing and equipment and in preventing noxious odors from being emitted into the ambient environment, i.e., a room, such as a hotel or motel room, or in a garage, where the sports player stores his equipment after a just completed game and before a subsequent game and until the clothing can be laundered and the equipment can be cleaned.

From the foregoing description, it will be apparent that the sports equipment drying container 10 of the present invention has a number of advantages, some of which have been described above and others which are inherent in the invention. Accordingly, the scope of the invention is only to be limited as necessitated by the accompanying claims.

I claim:

1. A portable sports equipment drying container comprising: a box shaped body; a cover for said body; said body having opposed side walls and opposed end walls; an input fan mounted in one of said walls; an output fan mounted in another one of said walls; a heating pad in said box shaped body; perforated or porous insulating means between said heating pad and clothing or equipment placed in said box shaped body; and means for energizing said fans and said heating pad for drying moist or wet clothing or equipment placed in said container and for circulating air through said container.

2. The sports equipment drying container of claim 1 wherein an air treatment cartridge is positioned adjacent an outlet side of said input fan whereby incoming air is pushed through said cartridge.

3. The sports equipment drying container of claim 2 wherein said air treatment cartridge contains at least one of a sterilizing material, a scenting material, a disinfectant material and a deodorizing material.

4. The sports equipment drying container of claim 1 wherein a air filter is mounted on an outlet side of said outlet fan.

5. The sports equipment drying container of claim 4 wherein said air filter is a carbon filter for deodorizing the air blown into an ambient environment.

6. The sports equipment drying container of claim 1 wherein said insulating means includes a plastic mat.

7. The sports equipment drying container of claim 6 wherein said insulating means includes a layer of hardware cloth between said heating pad and said bath mat.

* * * * *